US005769761A

United States Patent [19]

Zagata, Jr.

[11] Patent Number: 5,769,761

[45] Date of Patent: Jun. 23, 1998

[54] STRIKING BAG TRAINING APPARATUS

[76] Inventor: Ronald Zagata, Jr., 1570 King Arthur Way, Streetsboro, Ohio 44241

[21] Appl. No.: 889,130

[22] Filed: Jul. 7, 1997

Related U.S. Application Data

[60] Provisional application No. 60/022,566 Jul. 24, 1996.

[51] Int. Cl.[6] ..... A63B 69/00

[52] U.S. Cl. ..... 482/87; 482/83; 482/90

[58] Field of Search ..... 482/83–90, 148

[56] References Cited

U.S. PATENT DOCUMENTS

| | | | |
|---|---|---|---|
| 450,185 | 4/1891 | Peterson | 482/87 |
| 710,113 | 9/1902 | Maxwell | 482/87 |
| 868,557 | 10/1907 | Hurt | 482/87 |
| 4,084,812 | 4/1978 | Melrose | 482/87 |

*Primary Examiner*—Jerome Donnelly
*Attorney, Agent, or Firm*—Richard C. Litman

[57] ABSTRACT

An appendage for striking bags used in the training of the martial arts and boxing. A head-sized striking bag intended to be used in conjunction with a conventional, freely hanging training bag, thereby forming a simulated head on the training bag. The head-sized striking bag includes an axial tube, a foam head torus having a hole therethrough mounted on the axial tube, and an outer wrap of study fabric encapsulating the head torus. A suspension apparatus is threaded through the axial tube and provides the linkage from an overhead suspension to the training bag. To assure safety and accurate simulation, a neck torus is added to the lower section of the head torus and a skirt is added which extends from the neck torus to the training bag to assure the boxer does not entangle his glove into the suspension chains. The present invention may be added to an existing training bag by mounting the head-sized striking bag in the location previously used to suspend the training bag and then attaching the training bag to the head-sized striking bag. The attachment of the training bag below the head-sized striking bag is made adjustable by utilization of snap hooks.

16 Claims, 3 Drawing Sheets

STRIKING BAG TRAINING APPARATUS

CROSS-REFERENCE TO RELATED APPLICATION

This application claims the benefit of U.S. Provisional Patent Application Ser. No. 60/022,566, filed Jul. 24, 1996.

BACKGROUND OF THE INVENTION

1. FIELD OF THE INVENTION

The present invention relates to an appendage for striking bags used in the training of the martial arts and boxing. The present invention is a head-sized striking bag intended to be used in conjunction with a conventional, freely hanging training bag, thereby forming a simulated head on the training bag.

2. DESCRIPTION OF RELATED ART

Training for the martial arts and boxing requires hitting targets called punching or training bags. One popular punching bag used in boxing is the speed bag which is a head-sized pneumatic bag on a short suspension apparatus hanging from a rebound platform which effects a quick bounce response to a well placed punch and designed to train a person to hit accurately and quickly. Another bag is the heavier stuffed body sized bag on a swinging suspension and designed to train a person to place powerful body punches and maneuver to other optimum hitting positions to accommodate the swing of the bag. Over the years major improvements have been made to these body sized training bags that are directed at better simulation of a human body and bag responsiveness to placed blows.

The simulation of a human head by a head-sized striking bag for attachment to a training bag by compatible snap hooks and chains creates a flexible and versatile arrangement that permits the bags to be used in combination for head and body target training. The head-sized striking bag should be simply constructed from common plumbing tube stock, foam cushioning, tough fabrics such as leather, canvas, or vinyl, and general hardware of rope, chain, snap hooks and clamps, assuring a feasible low cost production item.

Relevant United States and Foreign patents discussing related art may be found in U.S. Pat. No. 1,267,678, issued on May 28, 1918, to William H. McArdle et al., U.S. Pat. No. 1,685,495, issued on Sep. 25, 1928, to Harry Latz, U.S. Pat. No. 2,826,416, issued on Mar. 11, 1958, to Claude J. Heffner, U.S. Pat. No. 2,909,370, issued on Oct. 20, 1959, to Elza L. Fortney, U.S. Pat. No. 3,250,533, issued on May 10, 1966, to Jack P. Nicholson II, U.S. Pat. No. 4,491,315, issued on Jan. 1, 1985, to Jeffrey Dye, U.S. Pat. No. 4,557,477, issued on Dec. 10, 1985, to Ivan C. Clements et al., U.S. Pat. No. 5,281,191, issued on Jan. 25, 1994, to Daniel A. DeSousa, U.S. Pat. No. 5,328,425, issued on Jul. 12, 1994, to Mark H. Knighton et al. and U.S. Pat. No. 5,437,590, issued on Aug. 1, 1995, to Louis D'Alto. PCT Patent Application Number WO 94/28981, published on Dec. 22, 1994 and Soviet Union Patent Application Number 1,657,213(A1), published on Jun. 23, 1991.

Upon review of the above-listed patent references, it is noted that striking or training bags have been the subject of earlier patents. Of particular interest is the PCT Patent Application Number WO 94/28981 which describes a freely hanging punch/kick bag which simulates a human body configuration; e.g., head, chin, neck, shoulders, and main torso. Furthermore, the patent to Dye describes a training bag including two separate and adjustable anatomical sections, namely a section representing the head and a section representing the body. In addition, the patent to McArdle describes a plurality of striking bags linked together to represent the human head and body.

The remainder of the above-listed patent references were selected to further illustrate relevant patents in the field of striking bags; i.e., versions of the conventional heavy training bag described by the patents to Heffner and Knighton et al., a floor version of a conventional bag described by the patent to Clements et al., dummy simulations described by the patents to Fortney, Latz and DeSousa, and bags with reactive mechanized components described by the patents to Nicholson II, D'Alto and Khasanov of the Soviet Union.

All of the above inventions and patents are composite training bags made as unitary structures. There is no teaching or suggestion in these patents of manufacturing a head-sized striking bag, and then attaching this bag to a conventional bag. The present invention does describe such a head-sized striking bag which allows for the separate replacement of either the main training bag or the head-sized striking bag if either becomes worn without the need for replacing the entire structure.

None of the above inventions and patents, taken either singularly or in combination, is seen to describe the instant invention as claimed. Thus a head-sized striking bag for use in conjunction with a conventional heavy training bag solving the aforementioned problems is desired.

SUMMARY OF THE INVENTION

The present invention relates to an appendage for striking bags used in the training of the martial arts and boxing. The present invention is a head-sized striking bag intended to be used in conjunction with a conventional, freely hanging training bag, thereby forming a simulated head on the training bag.

The head-sized striking bag includes an axial tube, a foam head torus having a hole therethrough mounted on the axial tube, and an outer wrap of study fabric encapsulating the head torus. The circumferential periphery of the head torus may be laminated with a sheet of foam laminate, which is selected for its integrity and resiliency to the abuse which it will suffer. A suspension apparatus is threaded through the axial tube. The suspension apparatus provides the linkage from an overhead suspension to the training bag. To assure safety and accurate simulation, a neck torus is added to the lower section of the head torus and a skirt is added which extends from the neck torus to the training bag to assure the boxer does not entangle his glove into the suspension chains.

The present invention may be added to an existing training bag by mounting the head-sized striking bag in the location previously used to suspend the training bag and then attaching the training bag to the head-sized striking bag. The attachment of the training bag below the head-sized striking bag is made adjustable by utilization of snap hooks. The present invention is constructed of durable and cost effective parts including foam cylindrical torus, strong tubing, a tubing end collar, clamps, foam rubber, rope, chain, snap hooks and a protective cover made of vinyl, leather or other suitable material.

Accordingly, it is a principal objective of the invention to create a head-sized striking bag which may be easily attached to a conventional training bag so as to create a more realistic training bag for the martial arts and boxing.

It is another objective of the invention to create a versatile training target with an adjustable head-sized appendage.

It is a further objective of the invention to create a low cost head-sized appendage which may be salvaged for continued use on replacement training bags.

It is an objective of the invention to provide improved elements and arrangements thereof for the purposes described which is inexpensive, dependable and fully effective in accomplishing its intended purposes.

These and other objectives of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
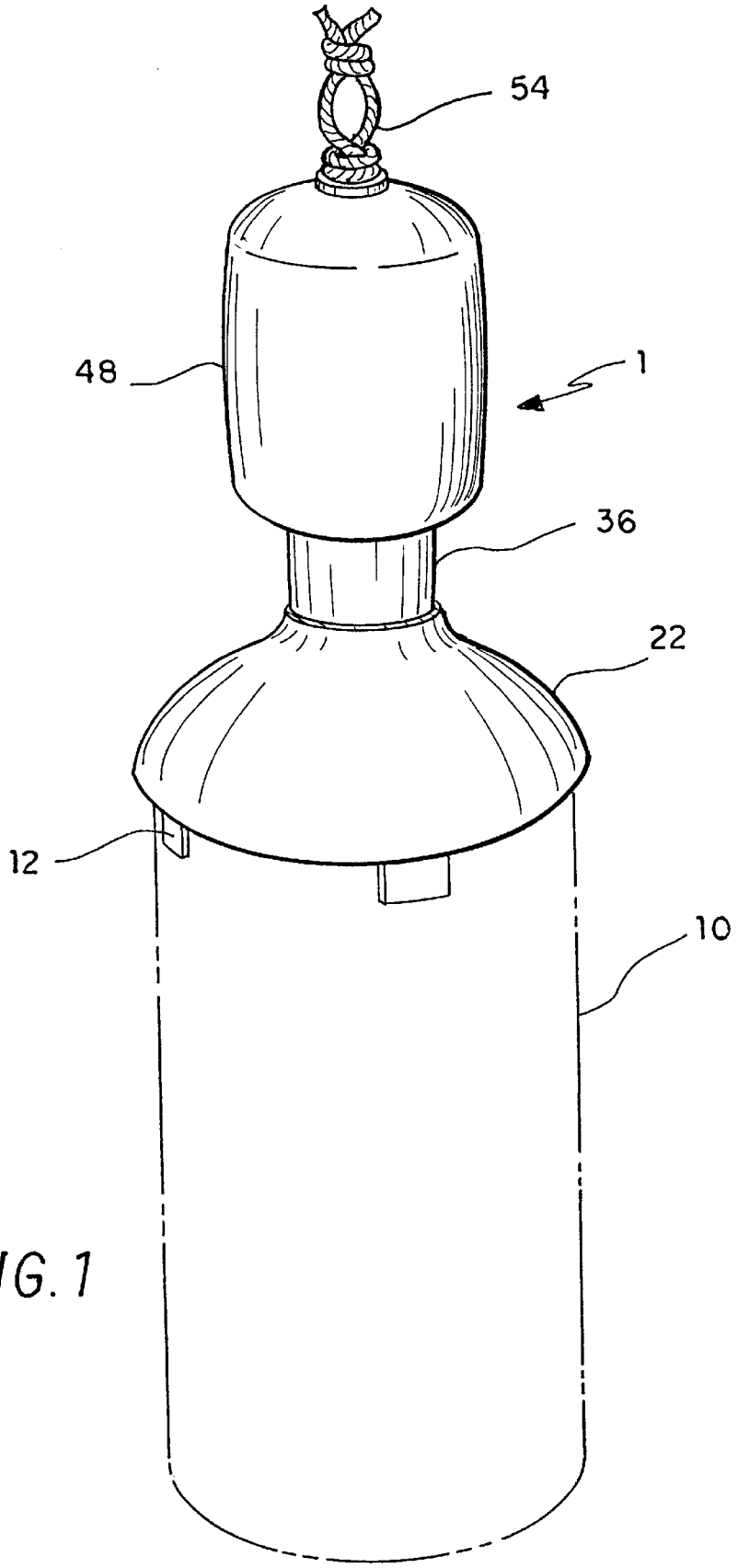
FIG. 1 is a perspective view of a striking bag training apparatus according to the present invention.
Figure 2:
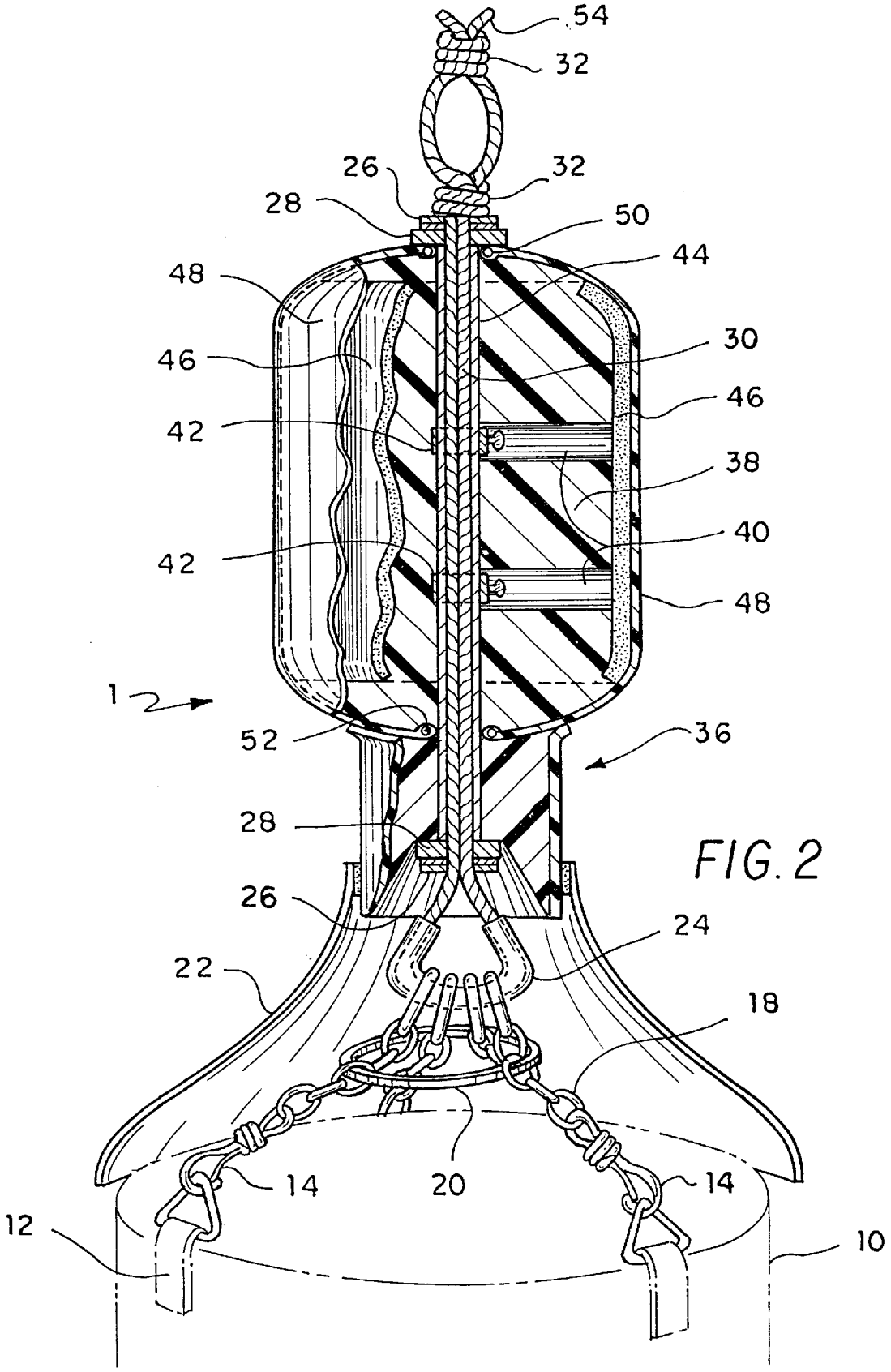
FIG. 2 is an enlarged sectional view of the internal assembly of a striking bag training apparatus according to the present invention.

Referring to FIGS. 1 and 2, the present invention is a head-sized striking bag 1 intended to be used in conjunction with a conventional, freely hanging training bag 10, thereby forming a simulated head on the training bag for more realistic training.

The head-sized striking bag 1 simulates a human head in size and position. The present invention is attached to the training bag in a rugged, yet safe manner. The present invention is designed and configured so as that it does not diminish the classical training function of the training bag 10.

The internal structure of the head-sized striking bag 1, as shown in FIG. 2, is formed by laminating a foam head torus 38 set to an axial tube 44 with a sheet of appropriate foam laminate 46 and tying the assembly closed in an outer wrap 48 of sturdy fabric. A suspension apparatus 54 is threaded through the axial tube 44. The suspension apparatus 54 provides the linkage from an overhead suspension to the training bag 10.

The conventional training bag 10 has four support rings which are usually connected to a suspension of four independent snap hooks on chains. The preferred embodiment of the suspension apparatus 54 of the present invention imitates this conventional system of snap hooks on chains. In the preferred embodiment, four snap hooks 14 on four chains 18 are connected to a rope loop 30 which is threaded through the axial tube 44 and tied with a locking knot 32 as dictated by the art of marlinespike, and augmented with appropriate chain and rode hardware of thimbles, link retainers, whipping thread and bindings, as needed. To assure safety and accurate simulation, a neck torus 36 is added to the lower section of the head torus 38 and a skirt 22 is added which extends from the neck torus 36 to the training bag 10 to assure the boxer does not entangle his glove into the suspension chains 18.

The head-sized striking bag is mounted over a tube 44, which is constructed of a sturdy material such as conventional schedule 80 plastic plumbing pipe. The tube 44 channels the coupling of the suspension apparatus 54 that holds the training bag 10 to an overhead support apparatus. As shown in FIG. 2, the head torus 38, which is made of foam of appropriate resiliency is slipped over the tube 44. A tube collar 28 is attached to the top of the tube 44 to retain the head torus 38 and prevent chaffing of the suspension apparatus 54 at the top collar.

The head torus 38 has at least one access hole 40 to gain access to the axial tube 44 and internally secure the head torus 38 to the tube 44 with clamps 42. The clamps 42 prevent the head torus 38 from sliding axially along the axial tube 44. The clamps 42 may be conventional stainless steel hose clamps or any other device capable of preventing the head torus 38 from sliding axially along tube 44. The access hole 40 may then be sealed with a plug of foam. The circumferential periphery of the head torus 38 is laminated with sheet section of foam laminate 46, which is selected for its integrity and resiliency to the abuse which it will suffer.

A neck torus 36 of lesser diameter than the head torus 38 is slipped on the tube 44 under the head torus 38, so as to simulate a neck. The neck torus 36 is preferably long enough to crowd the bottom of the tube 44, onto which is placed another tube collar 28 to retain the bottom extremity of the neck and head assembly. The overhang of the resilient lower portion of the neck gives some protection from a direct hit to the bottom tube collar 28.

The preferred embodiment of the suspension apparatus 54 includes a rope loop 30 slipped through the axial tube 44. A rope of adequate length and strength is folded in half, set in a rope thimble 24, and passed through a pair of washer bearings 26, which could be of Teflon® to avoid abrasive cutting of the lower rope section wrapped about the thimble 24. Furthermore, good marlinespike art may require a binding about the paired rope where it passes up through the collar 28. The pair of rope ends are then fed up through the tube 44, out the collar 28 at the tube top, through another pair of washer bearings 26, and secured with appropriate locking knots 32, so the top of the rope loop 30 may be mounted to an overhead suspension apparatus.

If chains 18 are used to connect the thimble 24 to the strapped support rings 12 of the training bag 10, the chains 18 may be attached to the thimble 24 by split links used for mating chain pieces, or the chain end links may be threaded onto the thimble 24 before attaching the thimble into the fold of the rope. It also may be necessary to gather the suspending chain 18 in a chain retainer 20 which is a strong metal loop threaded through a link in each chain. The purpose of the chain retainer is stress relief on the thimble 24 from the shock loads transmitted from the training bag 10 through a taut, almost horizontal, chain filament. On the last link of each chain 18 is a snap hook 14 for engaging the strapped support ring 12 of the training bag 10. The snap hook 14 may be used to adjust the height of the training bag 10 by threading the snap hook 14 through the strapped support ring 12 and connecting the snap hook 14 to a chain link 18. Alternatively, the snap hook 14 could be replaced by a permanent connector, such as a chain link, thereby making the head-sized training bag 1 and the conventional training bag 10 a single unit.

Figure 3:
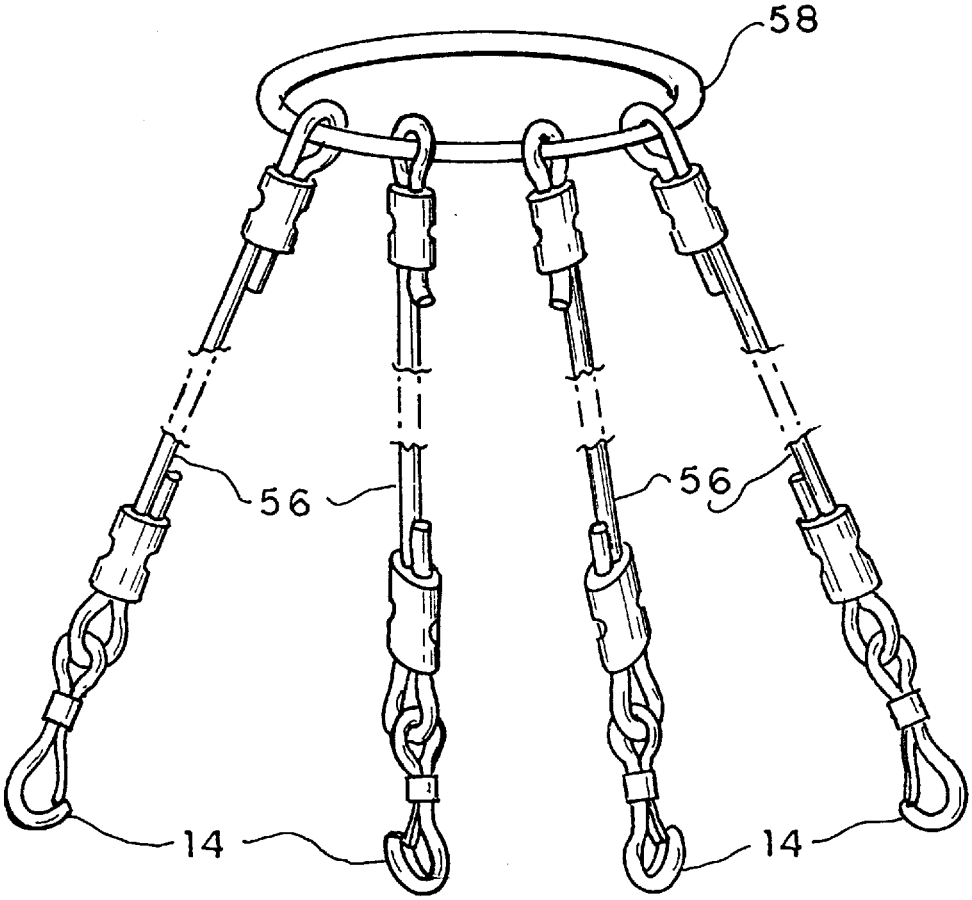
FIG. 3 is an enlarged perspective view of a suspension apparatus of the present invention using steel cables.

It is implied in the suspension apparatus of the preferred embodiment that items may be substituted for functional equivalents. For example, as shown in FIG. 3, steel cable 56 attached, by crimping or other conventional method, to a suspension ring 58 and terminating in snap hooks 14 may be used instead of rope or chain or even substituted for both. Additionally, nylon strap material, similar to that used for conventional seat belts, may be substituted for the steel cables, ropes and chains. In any variation of a suspension apparatus, parts may be omitted or substituted for the sake of simplicity and cost savings. Though the conventional foam rubber is suggested for the head-sized striking bag, it is not to the exclusion of other resilient composites such as silicones or foam plastics.

The head torus 38 is covered by a laminate 46. Over the outside of the laminated head torus is an outer wrap 48 which is secured with an upper tie 50 and a lower tie 52, giving the head-sized striking bag 1 a reasonable shape, protection and durability. A neck torus 36 is below the head-sized section. To the neck torus 36 may be added a skirt 22 with some securing apparatus to the neck torus 36 and or the belted support rings 12 to assure the trainee will not drive his glove or foot into the suspension apparatus running from the bottom of the head-sized striking bag to the training bag.

This invention may be produced as an end product or supplied as a kit to be assembled by a purchaser or even to be practiced as a process for manufacturers of conventional bags to improve their product.

It is to be understood that the present invention is not limited to the embodiments described above, but encompasses any and all embodiments within the scope of the following claims.

I claim:

1. A striking bag training apparatus for use with a conventional training bag having a plurality of support rings, said training apparatus comprising:

an axial tube;

a head torus having a first center axis and a first center axis hole extending along said first center axis, said axial tube being fixed within said first center axis hole; and means for hanging the training bag from a support, said means for hanging the training bag from the support being threaded through and attached to said axial tube, and said means for hanging the training bag from the support being attachable to the plurality of support rings on the training bag.

2. The striking bag training apparatus according to claim 1 wherein said means for hanging the training bag from the support is detachably attachable to the support rings on the training bag.

3. The striking bag training apparatus according to claim 1 wherein:

said head torus has an access hole extending from an outer surface on said head torus to said first center axis hole; and a clamp is secured to an outer surface of said axial tube at a position on said axial tube adjacent to said access hole.

4. The striking bag training apparatus according to claim 3 wherein a plug is mounted within said access hole, said plug substantially filling said access hole.

5. The striking bag training apparatus according to claim 1 wherein said head torus has an outer surface, said outer surface being covered with a foam laminate material.

6. The striking bag training apparatus according to claim 1 further comprising a neck torus having a second center axis and a second center axis hole extending along said second center axis, said axial tube extending along the length of said second center axis hole, and said neck torus having a smaller diameter than said head torus.

7. The striking bag training apparatus according to claim 6 further comprising a skirt having a first end and a second end, said first end being attached to said neck torus the training bag end extending to the training bag.

8. The striking bag training apparatus according to claim 1 further comprising a skirt having a first end and a second end, said first end being attached to said head torus the training bag end extending to the training bag.

9. The striking bag training apparatus according to claim 1 further comprising an outer wrap substantially encapsulating said head torus.

10. The striking bag training apparatus according to claim 9 wherein said outer wrap is substantially cylindrically shaped with a first end and a second end, said first end having a first tie and said second end having a second tie.

11. The striking bag training apparatus according to claim 1 wherein said means for hanging the training bag from the support comprises:

an elongated member having a folded midsection and two end sections positioned adjacent one another, said end sections extending through said axial tube;

a locking knot set snugly to said end sections of said elongated member to engage the support; and a multiplicity of connectors interconnecting said midsection of said elongated member and the support rings.

12. The striking bag training apparatus according to claim 11 wherein said elongated member is a rope.

13. The striking bag training apparatus according to claim 11 wherein said elongated member is a strap.

14. The striking bag training apparatus according to claim 11 wherein said multiplicity of connectors are chains.

15. The striking bag training apparatus according to claim 11 wherein said multiplicity of connectors are straps.

16. The striking bag training apparatus according to claim 11 wherein said multiplicity of connectors each includes:

a chain having a first end and a second end, said first end of said chain being connected to said midsection of said elongated member; and a snap hook having a first end and a second end, said first end of said snap hook being attached to said second end of said chain, said second end of said snap hook being detachably connected to the support rings.

* * * * *